United States Patent [19]

Szoboszlai et al.

[11] Patent Number: 4,687,271

[45] Date of Patent: Aug. 18, 1987

[54] INSTRUMENT PLUG LOCKING DEVICE

[75] Inventors: Istvan Szoboszlai, Veyrier du Lac; Christian Roucher, La Balme de Sillingy, both of France

[73] Assignee: ITT Composants et Instruments, Bagneux (Hauts-de-Seine), France

[21] Appl. No.: 908,499

[22] Filed: Sep. 17, 1986

[30] Foreign Application Priority Data

Sep. 23, 1985 [FR] France ..... 85 14046

[51] Int. Cl.[4] ..... H01R 13/639

[52] U.S. Cl. ..... 439/350; 439/369

[58] Field of Search ..... 339/91 R, 260, 75 R, 339/75 P

[56] References Cited

U.S. PATENT DOCUMENTS

| | | | |
|---|---|---|---|
| 1,928,580 | 9/1933 | Watts | 339/91 R |
| 3,046,513 | 7/1962 | Crowley | 339/91 R |
| 3,643,205 | 2/1972 | Elkins | 339/91 R |
| 3,659,248 | 4/1972 | Mann et al. | 339/91 R |
| 4,227,762 | 10/1980 | Scheiner | 339/91 R |
| 4,319,733 | 3/1982 | Hanna et al. | 339/91 R |

FOREIGN PATENT DOCUMENTS

| | | | |
|---|---|---|---|
| 580821 | 9/1946 | United Kingdom | 339/91 R |
| 896119 | 5/1962 | United Kingdom | 339/91 R |

*Primary Examiner*—John McQuade

*Attorney, Agent, or Firm*—T. L. Peterson

[57] ABSTRACT

A locking device for retaining in position an electrical connection plug pumped into a socket in a measuring instrument. The device is a molded plastic adapter releasably secured to the instrument. The device has a hinge and a tab that extends transversely over the socket. The tab is provided with a hole which the plug crosses through, whose edge opposite the hinge cooperates with the plug to retain the plug in the socket. The hinge may be deformed to shift the tab laterally to release it from the plug.

9 Claims, 3 Drawing Figures

INSTRUMENT PLUG LOCKING DEVICE

BACKGROUND OF THE INVENTION

1. Field of the Invention

The present invention relates to a locking device designed to secure an electrical connection plug plugged into a measuring instrument.

2. Description of the Prior Art

In the field of electrical connection means, locking devices are known, which generally consist of an elastic part secured to the instrument and which cooperates, through its shape, with a part of the plug to retain the plug in position. This part can be elastically deformed in order to release the plug.

Measuring instruments generally comprise two cords terminating in plugs, on the instrument side, and probes, on the measuring point side. The plugs of these cords plug into two or several sockets provided in the housing of the instrument. These plugs are retained in place by the friction between the connecting components of the plug and the socket.

However, it happens that the plugs are submitted to relatively strong forces resulting from a pulling load on the cords and the connection components can thus be damaged, whereas the connection can unexpectedly be released.

The addition of locking means to secure the plugs in measuring instruments is therefore desirable. However, this should meet a number of conditions, the main one being that the instrument should entail slight modifications only and this, without any additional cost. In fact the locking device is not always necessary and a special version of the instrument comprising a locking device should be avoided. Obviously, sealing of the housing must be preserved. It is further necessary to preserve the aesthetic appearance of the instrument. Finally, of course, the locking device itself must be reliable and cheap.

It is an object of the present invention to provide a locking device which satisfies these conditions.

SUMMARY OF THE PRESENT INVENTION

The locking device of the present invention includes a tab secured to the instrument by a hinge and transversally arranged over the opening of the socket receiving the plug. The tab is provided with a hole through with the plug passes, and whose edge opposite the hinge cooperates with a part of the plug to retain it in the socket.

With this solution the tab acts as a link around the plug at least partially and working tractively when the cord is pulled. The engagement of the edge of the tab with the plug increases with the tractive load, so that the plug is firmly retained in the socket.

According to another feature of the invention, the hinge is an elbowed part whose one end carries the tab at a certain distance from the surface of the instrument housing and the other end of the elbowed part extends toward this surface. In this way deformation of the elbowed part will enable the tab to move elastically, so as to unlock and lock. To facilitate these actions, a push part is associated with the hinge.

As an instrument comprises several sockets, each one will be provided with locking means, by providing a number of tabs each connected by a hinge to a common locking adapter. The latter is formed with fastening means arranged for a detachable locking on the housing. Finally, the locking device as a whole will have the form of a molded plastic part adaptable to the housing of an instrument, that can be used without this part which will be a cheap accessory for the instrument.

DESCRIPTION OF THE PREFERRED EMBODIMENT

Figure 1:
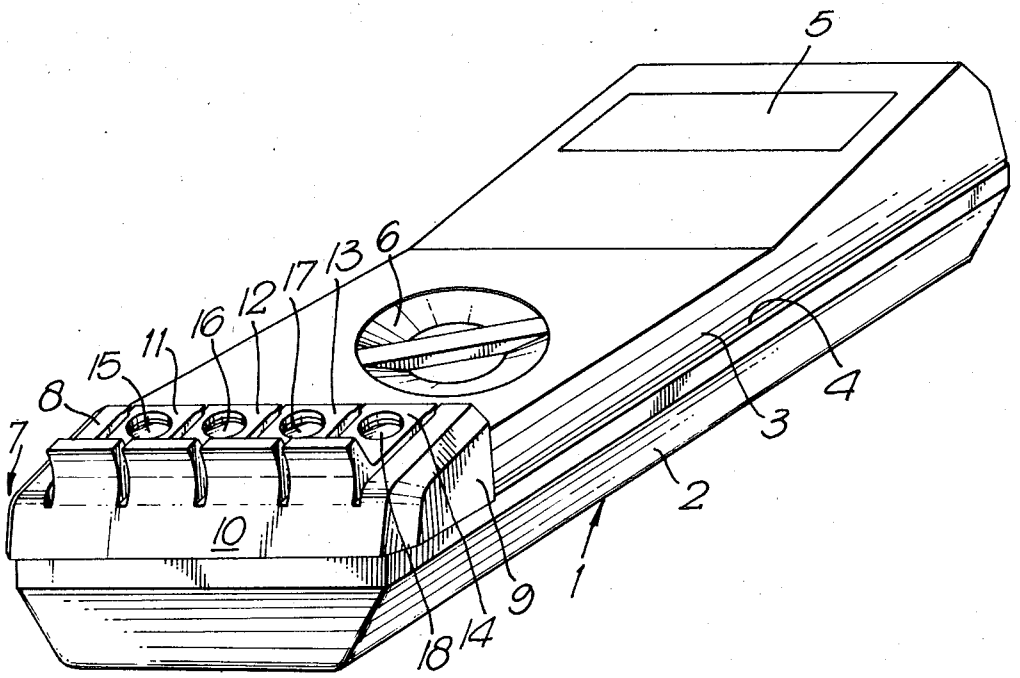
FIG. 1 is a perspective view of a measuring instrument provided with the locking device of the present invention.

The instrument in FIG. 1 is a conventional instrument having a housing comprised of two parts 2 and 3, between which can be seen a stepping 4 marking the joint plane between the parts. The instrument also includes a screen 5 of a digital display unit and a range selector switch 6.

The locking device 7 is mounted over the forward end of the housing 1 for cord connection, to be described further below. This device contains two flanges 8 and 9 joined by a cross-member 10 and forming a locking adapter carrying the four tabs 11, 12, 13, 14 corresponding to the four sockets. These four tabs are provided with holes 15, 16, 17, 18 in which the plugs of the cords are plugged into the sockets as required. The tabs are used to secure the plugs in position as will now be seen by referring to FIGS. 2 and 3.

Figure 3:
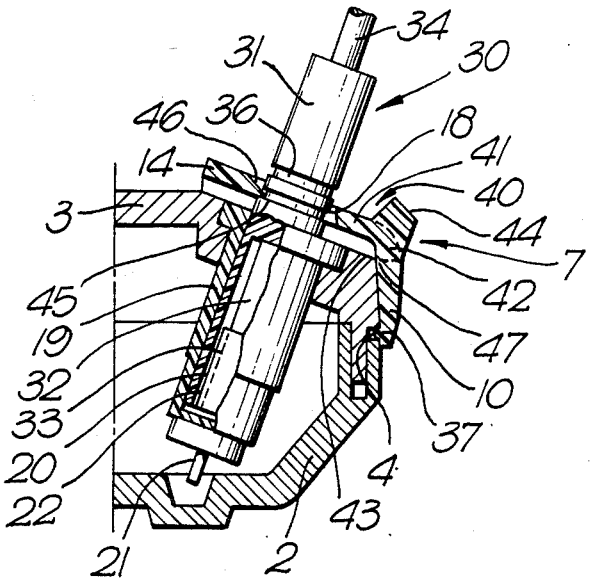
FIG. 3 is a partial cross-sectional view of the front end of the measuring instrument, with a plug plugged in and locked by the device.

First, FIG. 3 shows the front end of housing 1, in longitudinal cross-section through the axis of hole 18 in tab 14. Here are found again the upper (3) and lower (2) parts of housing 1, together with stepping 4 forming the joint plane between these two parts.

Fitted in the upper part 3 of the housing is a cylindrical part 19 containing a socket 20. The part 19 is formed of insulating plastic and is bonded or screwed to the housing 1. Socket 20 is formed of metal and extends by a pin 21 tight-sealed through the bottom of body 19.

FIG. 3 illustrates plug 30 basically consisting of a body 31 and a pin 32. The plug body is formed of insulating plastic, whereas pin 32 is metal. The pin is connected to the internal conductor of cord 34. As can be seen by broken lines of the FIG. 3, the outer surface 33 of pin 32 adapts to the inner surface 22 of socket 20 to obtain the required electrical contact.

Moreover the plug 30 is formed with two circular grooves 35, 36 which, in the absence of the locking device 7, would remain outside the housing 1 to indicate the depth to which the plug is plugged in and provided a grip to faciltate manual extraction.

Figure 2:
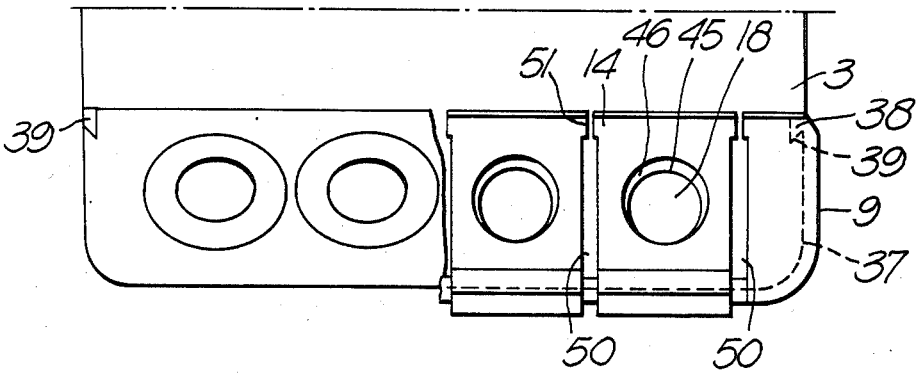
FIG. 2 is a fragmentary view showing the front part of the instrument, with and without the locking device of the invention.

FIG. 3 shows the locking device 7, with tab 14 and cross-member 10. The latter bears against part 3 of the housing and comprises a rib 37, which may be partial only, extending into the stepping 4. FIG. 2 shows that the locking device also contains a vertical rib 38, perpendicular to rib 37, cooperating with a cut 39 in part 3 of housing 1, at both ends of the device. These means provide for the detachable locking of device 7 to the housing 1 through insertion and sliding of ribs 38 in cuts 39 until rib 37 latches in stepping 4, as shown in FIG. 1. The dovetail form of ribs 38 and cuts 39 is such that device 7 can only be separated from housing 1 by a vertical force from bottom to top which cannot occur accidentally.

Tab 14 (FIG. 3) is attached to cross-member 10 by a hinge 40 containing an elbowed section whose one end 41 carries tab 14, in its extension, and whose other end 42 extends toward the surface 43 of housing 1 and is succeeded beyond it by cross-member 10.

The dimensions of this elbowed section are such that tab 14, in neutral position, as shown in particular in FIGS. 1 and 3, is parallel to the surface 43 of the housing which contains the connection sockets, at a predetermined distance from the surface.

This hinge 40 moreover contains a projection acting as a push part 44. By pushing on the push part 44 in the direction of the end of tab 14, plug 30 can be unlocked from the plug as will be seen later.

Recess 18 in tab 14 is off-set or eccentric with respect to the body of socket 19, as can be seen by comparing the two halves of FIG. 2 and observing the cross-sectional view in FIG. 3. The edge 45 of the hole 18 opposite hinge 40 partially overlaps the opening of the body of socket 19. Plug 30, when inserted into the socket 19, moves aside (to the left) edge 45 which slides on the outer surface of the plug until it snaps into groove 35. Thus, plugging is complete. To facilitate the plugging-in movement, hole 18 contains a chamfer 46 on the side of edge 45.

At this moment, the plug is effectively locked in the socket. An axial extraction force tends to lift tab 14 at the same time as the plug in the socket. This results in a force applied on edge 45 and supported at support point 47 where end 42 of the elbowed section reaches surface 43. This force is transverse and firmly retains the tab in the groove 35 and the whole plug against the opposite side of body 19 of the socket. The plug is thereby effectively and reliably held.

To release the plug, it is only necessary to apply a force on push part 44 or directly on tab 14, so as to drive it out of groove 35. Then the plug can be easily removed by means of a pulling force.

Now considering FIG. 2, at the same time as FIG. 1, it can be seen that the flat and parallel tabs are also aligned with the upper edge of flanges 8, 9 forming a thin block which covers the corner of the instrument housing without breaking its line. Between these tabs and flanges, there are provided slots 50 which are sufficiently wide to prevent any jamming, and lateral teeth 51 on the tabs which limit any lateral movement. These arrangements satisfy both mechanical requirements and concerns for aesthetic appearance.

The device 7 as a whole can be produced in a single, cheap part of molded plastic. Finally it will be observed that the only modification made to the instrument is the addition of grooves 39 in the thickness of the housing, so that tight sealing of this housing is in no way affected.

What is claimed is:

1. A locking device for releasably retaining an electrical connection plug in a housing having a socket adapted to receive said plug therein, comprising:

an elastic part adapted to be mounted on said housing;

said part embodying integral hinge means and a tab extending from said hinge means adapted to extend over said socket;

said tab having a hole therethrough adapted to overlap a portion of said socket;

the edge of said hole opposite to said hinge means adapted to cooperate with a plug to retain the plug in said socket; and said hinge means being deformable to shift said tab laterally whereby said edge can be released from the plug.

2. A locking device as set forth in claim 1 wherein:

said hinge means comprises an elbow-shaped section of said part, said section adapted to support said tab at a predetermined distance above said housing.

3. A locking device as set forth in claim 2 wherein:

a push part is associated with said hinge means, when said push part is pushed, said hinge means laterally deflects said tab through elastic deformation.

4. A locking device as set forth in claim 1 wherein:

said elastic part embodies a plurality of said tabs and associated hinge means.

5. A locking device as set forth in claim 1 including:

means on said elastic part for latching said part to the housing.

6. A housing assembly comprising:

a housing having a socket adapted to receive a plug therein;

a locking device mounted on said housing and adapted to retain an electrical connection plug in said socket;

said locking device comprising an elastic part embodying integral hinge means and a tab extending from said hinge means over said socket;

said tab having a hole therethrough overlapping a portion of said socket;

the edge of said hole opposite to said hinge means adapted to cooperate with a plug to retain the plug in said socket; and said hinge means being deformable to shift said tab laterally whereby said edge can be released from the plug.

7. An assembly as set forth in claim 6 wherein:

said hinge means comprises an elbow-shaped section of said part, said section supporting said tab at a predetermined distance above said housing.

8. An assembly as set forth in claim 6 wherein:

said housing embodies a plurality of said sockets; and said locking device comprises a plurality of said tabs and associated hinge means, each operatively associated with one of said sockets.

9. An assembly as set forth in claim 6 wherein:

said locking device comprises an integral molded adapter embodying latch means releasably latching the device to said housing.

* * * * *